US011375315B2

(12) United States Patent
Xiao et al.

(10) Patent No.: US 11,375,315 B2
(45) Date of Patent: Jun. 28, 2022

(54) SOUND GENERATOR

(71) Applicant: AAC Acoustic Technologies (Shenzhen) Co., Ltd., Shenzhen (CN)

(72) Inventors: Bo Xiao, Shenzhen (CN); Ronglin Linghu, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 375 days.

(21) Appl. No.: 16/679,324

(22) Filed: Nov. 11, 2019

(65) Prior Publication Data

US 2020/0154208 A1 May 14, 2020

(30) Foreign Application Priority Data

Nov. 12, 2018 (CN) ..... 201821858203.4

(51) Int. Cl.

| | |
|---|---|
| ***H04R 7/10*** | (2006.01) |
| ***H04R 7/16*** | (2006.01) |
| ***H04R 7/12*** | (2006.01) |
| ***H04R 31/00*** | (2006.01) |

(52) U.S. Cl.

CPC ..... *H04R 7/10* (2013.01); *H04R 7/127* (2013.01); *H04R 7/16* (2013.01); *H04R 31/003* (2013.01); *H04R 2307/023* (2013.01); *H04R 2307/025* (2013.01); *H04R 2307/029* (2013.01)

(58) Field of Classification Search

CPC . H04R 7/10; H04R 7/127; H04R 7/16; H04R 31/003; H04R 2307/023; H04R 2307/025; H04R 2307/029

See application file for complete search history.

(56) References Cited

U.S. PATENT DOCUMENTS

2014/0140543 A1* 5/2014 Yi ..... H04R 31/006 381/162

FOREIGN PATENT DOCUMENTS

KR 101737813 B1 * 5/2017

* cited by examiner

*Primary Examiner* — Sunita Joshi
(74) *Attorney, Agent, or Firm* — W&G Law Group

(57) ABSTRACT

A sound generator includes a frame, a magnetic circuit system and a vibration system accommodated in the frame. The vibration system includes a suspension. The suspension includes a first part and a second part attached to the first part. The first part includes a first middle portion, a first edge portion, and a first positioning portion. The second part includes a second middle portion, a second edge portion, and a second positioning portion. The second positioning portion is stacked on the first positioning portion, and is assembled with the first positioning portion by adhesive. The first edge portion is convex toward the frame, and the second edge portion is convex away from the frame, by which a sealed cavity is formed between the first and second edge portions. By virtue of such a configuration, the strength of the vibration system is improved.

7 Claims, 7 Drawing Sheets

SOUND GENERATOR

FIELD OF THE PRESENT DISCLOSURE

The present disclosure relates to the field of electromagnetic transducers, more particularly to a sound generator and a diaphragm used in the sound generator.

DESCRIPTION OF RELATED ART

A sound generator, also named speaker, is a very important component equipped in a mobile phone for producing audible sounds. A speaker generally uses a diaphragm to produce vibration and further to generate sounds. The diaphragm is a key factor to determine the performance of the sound generator. In a related sound generator, a frame is provided, and the sound generator further includes a magnetic circuit system and a vibration system accommodated in the frame. The vibration system includes a suspension mounted with the frame and a dome attached to a central portion of the suspension. In such a configuration, the combination strength of the dome and the suspension is weak, and a phenomenon called "membrane shrunken" will appear when the sound generator is used in a condition requiring deep-water resistance, which will cause the diaphragm to be broken. In addition, liner range of such a vibration system is narrow, which will lead to total harmonic distortion, and to bad high frequency performance.

Therefore, an improved diaphragm and a sound generator having such a diaphragm are desired.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

Figure 1:
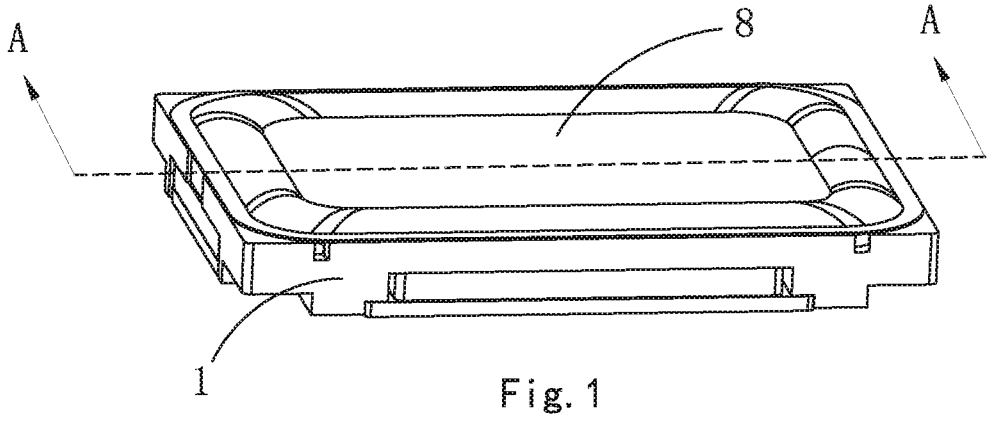
FIG. 1 is an isometric view of a sound generator in accordance with a first exemplary embodiment of the present disclosure.

The present disclosure will hereinafter be described in detail with reference to exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Embodiment 1

Referring to FIGS. 1-4, a sound generator in accordance with a first exemplary embodiment of the present disclosure is disclosed. The sound generator includes a frame 1, a magnetic circuit system 2 and a vibration system 3 accommodated in the frame 1, and a plurality of conductive terminals 4 assembled with the frame 1. The vibration system 3 includes a voice coil 5 and a suspension 6 attached to the frame 1 and connected with the voice coil 5. The magnetic circuit system 2 includes a magnetic yoke 21, a main magnet 22 mounted with the magnetic yoke 21, a pole plate 23 attached to a top of the main magnet 22, a plurality of auxiliary magnets 24 disposed around the main magnet 22, and an upper plate 25 attached to the auxiliary magnets 24. A magnetic gap 26 is formed between the main magnet 22 and the auxiliary magnets 24.

Figure 2:
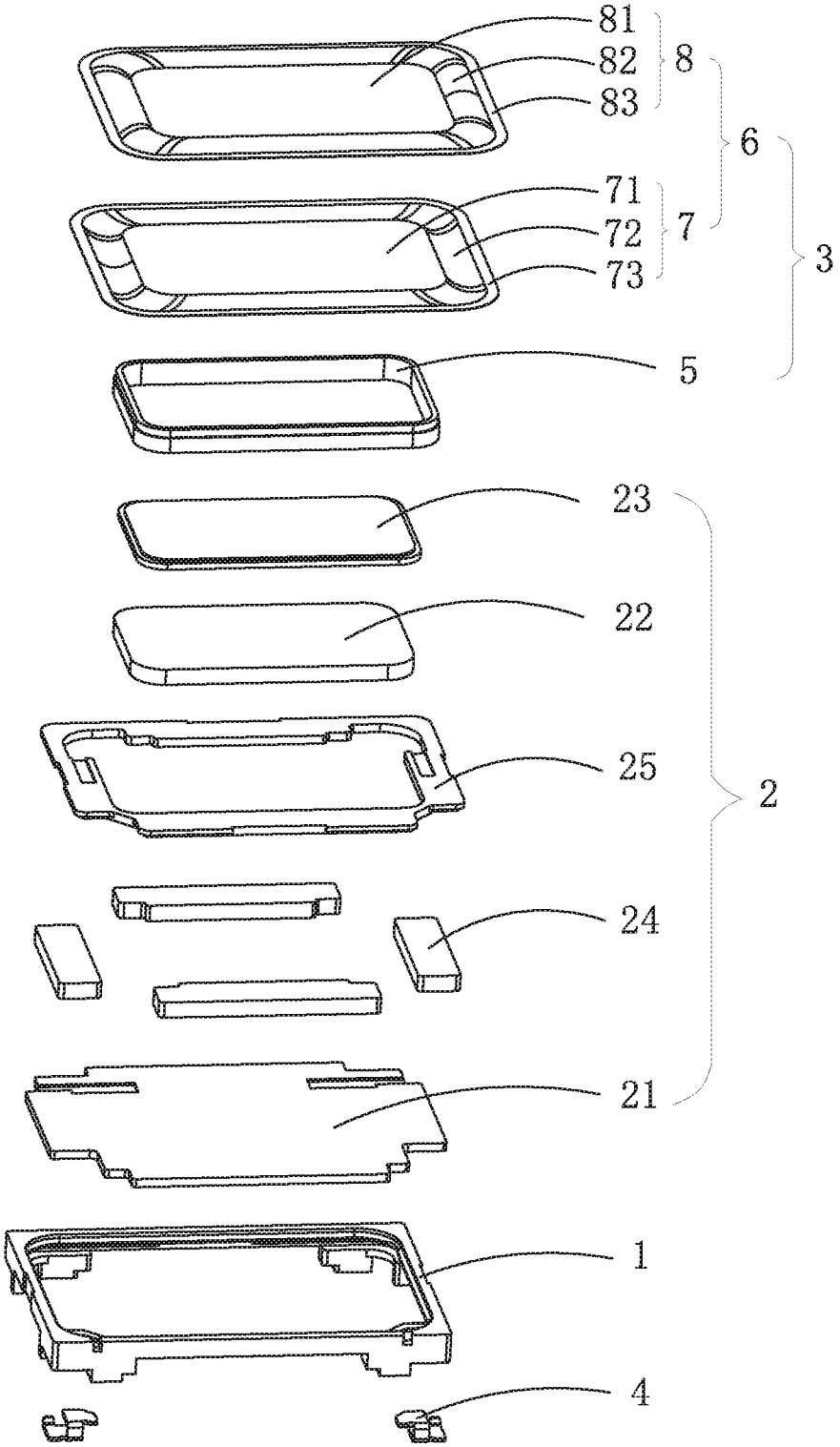
FIG. 2 is an exploded and isometric view of the sound generator in FIG. 1.
Figure 3:
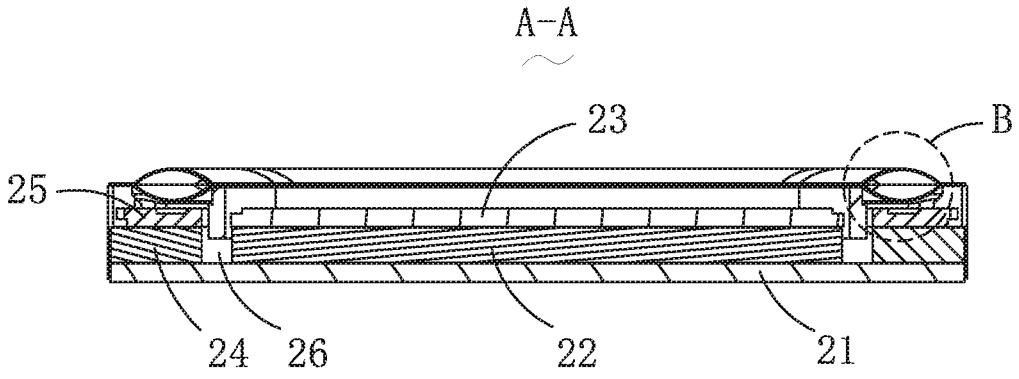
FIG. 3 is a cross-sectional view of the sound generator taken along line A-A in FIG. 1
Figure 4:
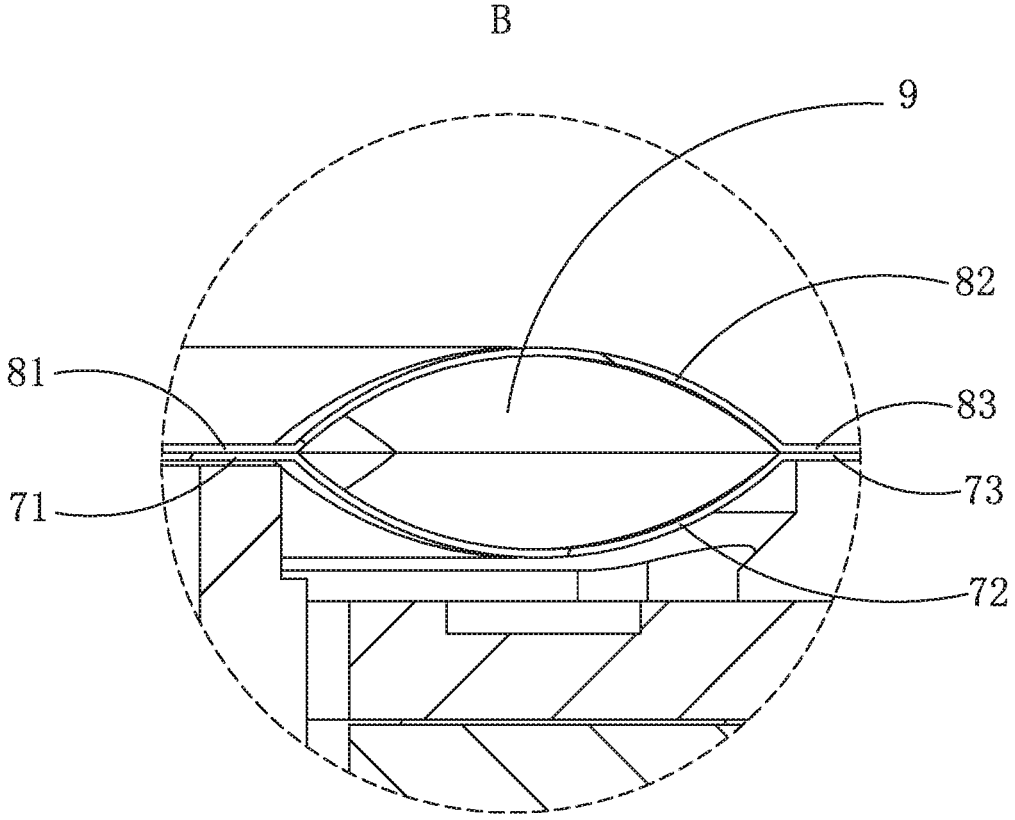
FIG. 4 is an enlarged view of Part B in FIG. 3.

Referring to FIGS. 2-4, the suspension 6 includes a first part 7 connected to the frame 1 and a second part 8 attached to the first part 7. The first part 7 includes a first middle portion 71, a first edge portion 72 extending far away from the first middle portion 71, and a first positioning portion 73 extending far away from the first edge portion 72. The second part 8 includes a second middle portion 81, a second edge portion 82 extending far away from the second middle portion 81, and a second positioning portion 83 extending far away from the second edge portion 82. The first part 7 and the second part 8 are formed by thermal molding separately. The second middle portion 81 is stacked on the first middle portion 71, and is assembled with the first middle portion 71 by adhesive. The second positioning portion 82 is stacked on the first positioning portion 72, and is assembled with the first positioning portion 72 by adhesive. The first edge portion 72 is convex toward the frame 1, and the second edge portion is convex away from the frame 1, by which a sealed cavity 9 is formed between the first and second edge portions 72, 82. By virtue of such a configuration, the strength of the vibration system is improved, and the phenomenon "membrane shrunken" is effectively solved. The diaphragm is protected from being broken. In addition, the configuration of "Dual Suspension" (i.e., the first part and the second part of the suspension) can effectively broaden the linear range of the vibration system, compared to the related art with a suspension having a same width. The total harmonic distortion of the sound generator is greatly decreased, especially to a sound generator with a great amplitude.

Embodiment 2

Figure 5:
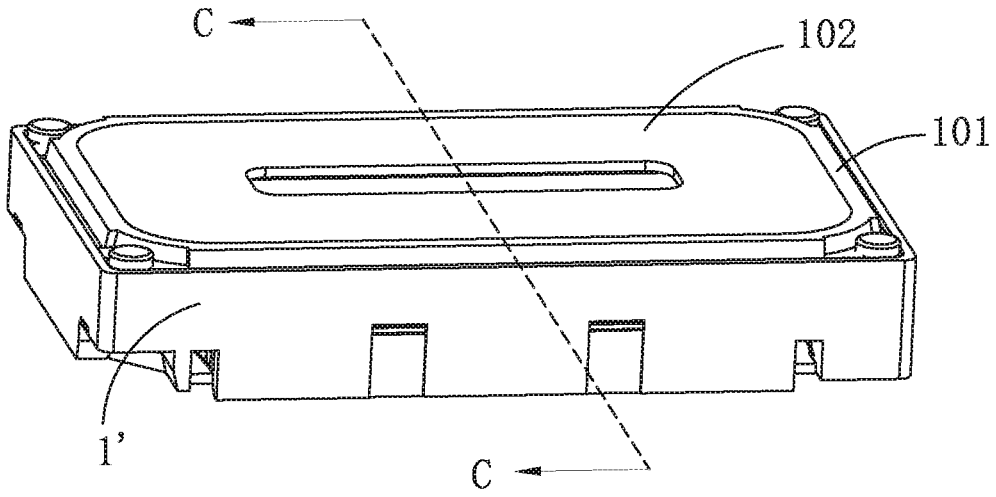
FIG. 5 is an isometric view of a sound generator in accordance with a second exemplary embodiment of the present disclosure.
Figure 6:
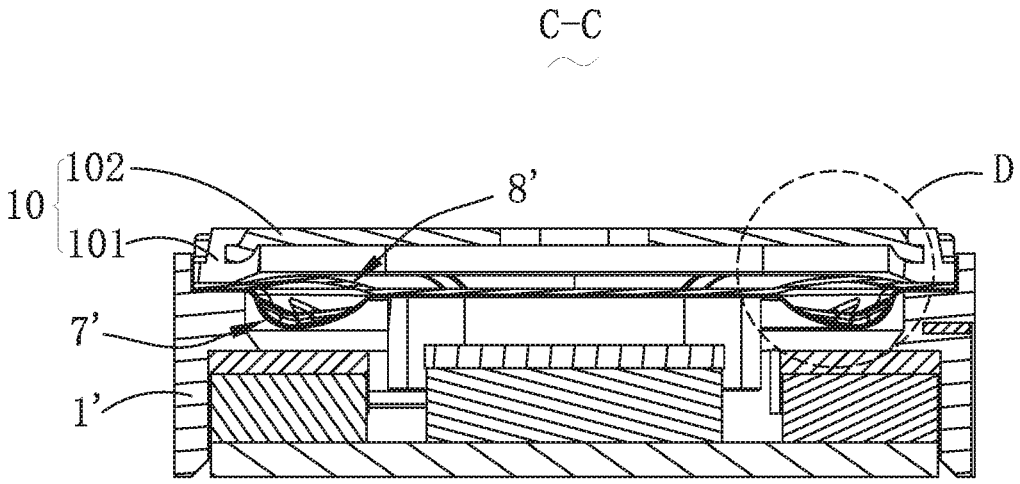
FIG. 6 is a cross-sectional view of the sound generator taken along Line C-C in FIG. 5.
Figure 7:
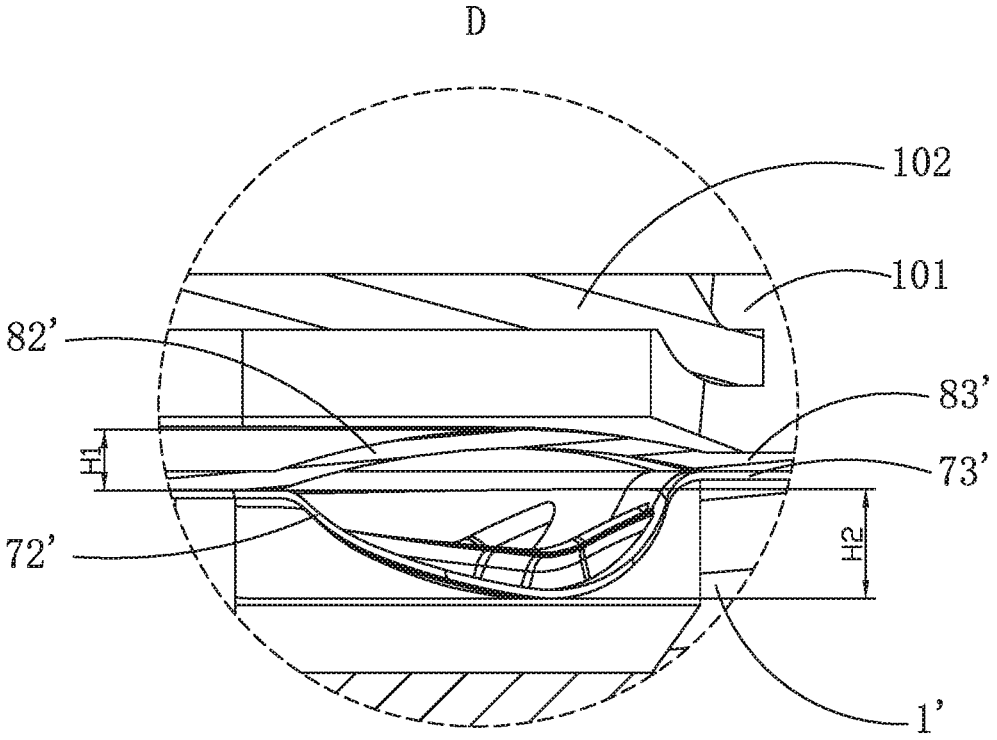
FIG. 7 is an enlarged view of Part D in FIG. 6.
Figure 8:
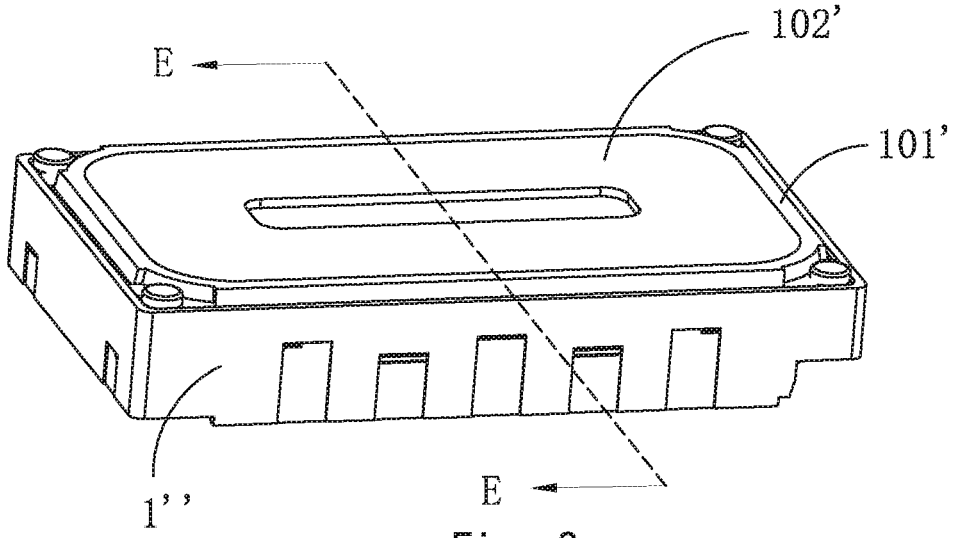
FIG. 8 is an illustration of a sound generator in accordance with a third exemplary embodiment of the present disclosure.
Figure 9:
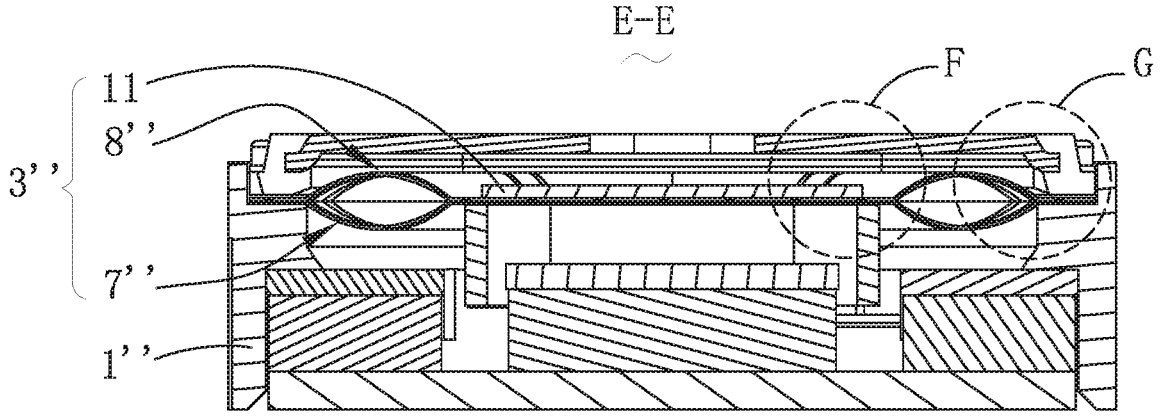
FIG. 9 is a cross-sectional view of the sound generator taken along Line-E-E in FIG. 8.
Figure 10:
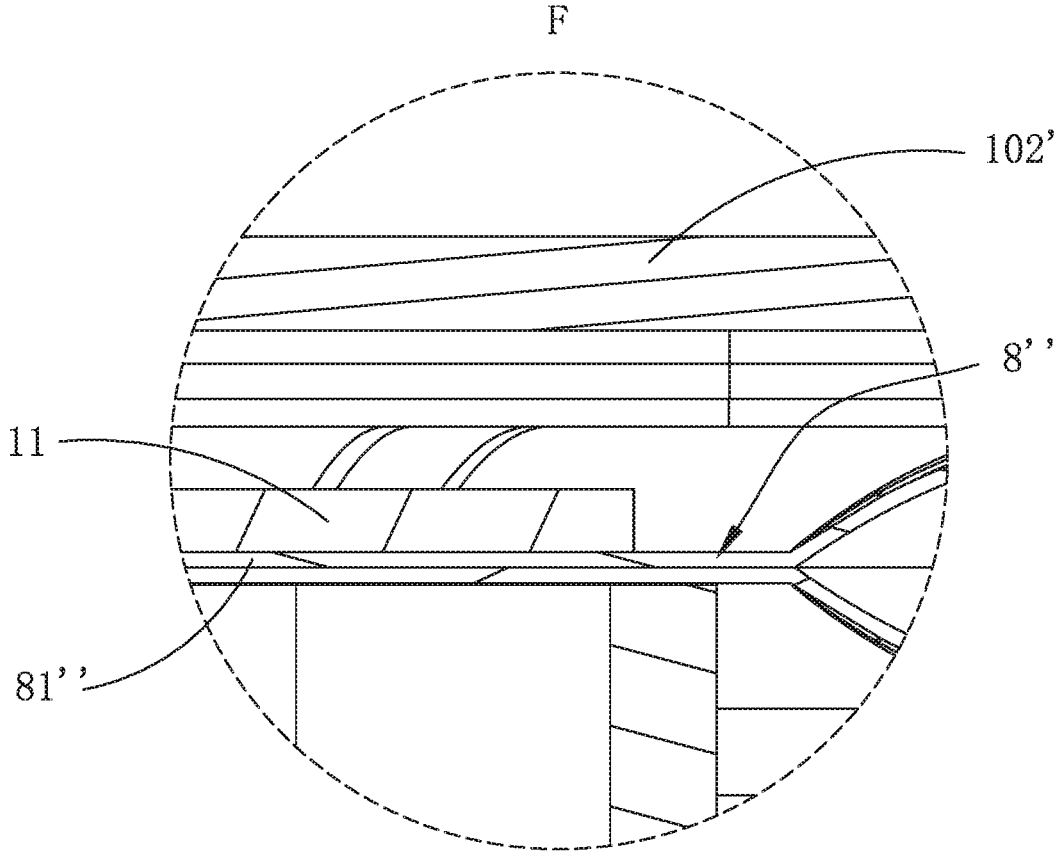
FIG. 10 is an enlarged view of Pat F in FIG. 9.
Figure 11:
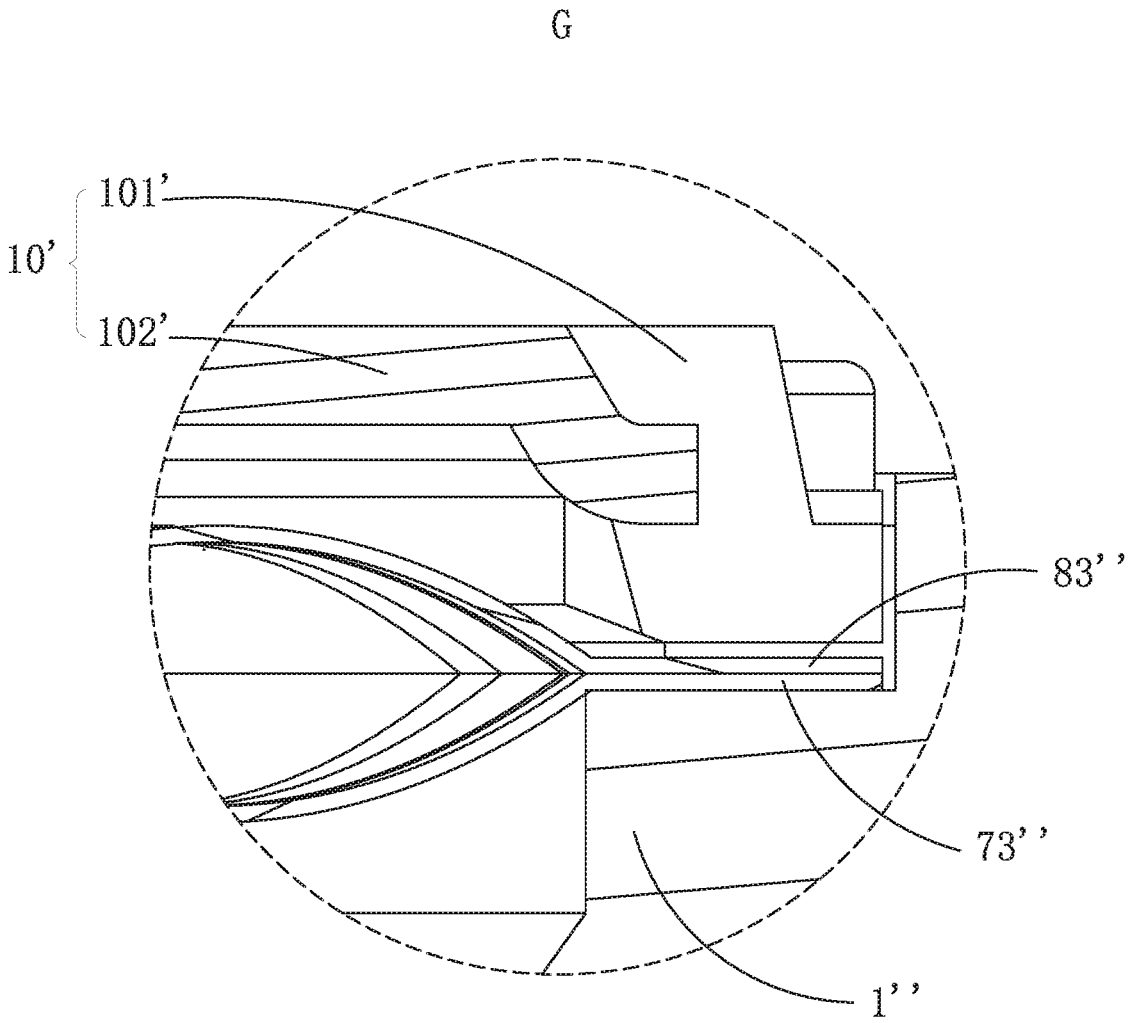
FIG. 11 is an enlarged view of Part G in FIG. 9.

Referring to FIGS. 5-7, a sound generator in accordance with a second exemplary embodiment of the present disclosure is disclosed. The sound generator in the second embodiment is basically same to the sound generator in the first embodiment. The differences therebetween are that the frame 1' is coupled with a top cover 10 having a top cover body 101 and a metal plate 102 embedded in the top cover body 101. The first positioning portion 73' is adhered to the second positioning portion 83' then they are sandwiched between the frame 1' and the top cover 10. The second edge portion 82' is convex far away from the frame 1' and forms a first height H1, and the first edge portion 72' is convex toward the frame 1' and forms a second height H2. The first height H1 is smaller than the second height H2. The first part 7' is formed by TPEE (Thermoplastic Polyether Ester Elastomer). The second part 8' is a three-layer-structure including a layer of TPEE, a layer of carbon fiber, and a layer of PEEK (Polyether-ether-ketone). The configuration of dual-suspension made of high elasticity materials improves the strength of the vibration system.

Further, the top cover 10 attached to the frame 1' is used for sandwiching the first positioning portion 73' and the second positioning portion 83' between the frame 1' and the top cover 10, such that the combination strength between the first part 7' and the second part 8' is improved, and the waterproof grade is effectively improved.

Furthermore, the second part 8' serves as a dome of the related art, but has a similar structure to the first part 7' and has a greater effective vibration area. And, due to the material, second part 8' is relatively soft along a vibration direction of the vibration system, and is relatively rigid along a direction perpendicular to the vibration direction, by which the high frequency direction of the sound generator is improved, and the vocal range is broadened.

The configuration and the material of the second part 8' increases the effective vibration area of the diaphragm, which makes the high frequency improve to ultrasonic frequency band (20~40 KHz), and makes it possible to serve as a key component of gesture recognition.

Embodiment 3

Referring to FIGS. 8-11, a sound generator in accordance with a third embodiment of the present disclosure is disclosed. The differences form the first embodiment are that the frame 1" is coupled with a top cover 10' having a top cover body 101' and a metal plate 102' embedded in the top cover body 101'. The first positioning portion 73" is adhered to the second positioning portion 83" then are sandwiched between the frame 1" and the top cover 10'. The vibration system 3" further includes a dome 11 attached to the second middle portion 81" of the second part 8". The first part 7" is provided with one or two layers adhered to each other and formed by PEEK (Polyether-ether-ketone). The second part 8" is formed by TPEE (Thermoplastic Polyether Ester Elastomer). The configuration of dual-suspension made of high elasticity materials improves the strength of the vibration system. The dome is made of alloy materials selected from aluminum alloy, magnesium alloy, magnesium lithium alloy, aluminum lithium alloy and titanium alloy, or made of polymer materials selected from polyethylene and polyester.

Further, the top cover 10' attached to the frame 1" is used for sandwiching the first positioning portion 73" and the second positioning portion 83" between the frame 1" and the top cover 10', such that the combination strength between the first part 7" and the second part 8" is improved, and the waterproof grade is effectively improved. By virtue of such a configuration, the strength of the vibration system is improved, and the phenomenon "membrane shrunken" is effectively solved. The diaphragm is protected from being broken. In addition, the configuration of "Dual Suspension" (i.e., the first part and the second part of the suspension) can effectively broaden the linear range of the vibration system, compared to the related art with a suspension having a same width. The total harmonic distortion of the sound generator is greatly decreased, especially to a sound generator with a great amplitude.

The present disclosure provides a sound generator with a diaphragm having a suspension including a first part and a second part for forming a sealed cavity. The configuration of dual-suspension made of high elasticity materials improves the strength of the vibration system. By virtue of such a configuration, the strength of the vibration system is improved, and the phenomenon "membrane shrunken" is effectively solved. The diaphragm is protected from being broken. In addition, the configuration of "Dual Suspension" (i.e., the first part and the second part of the suspension) can effectively broaden the linear range of the vibration system, compared to the related art with a suspension having a same width. The total harmonic distortion of the sound generator is greatly decreased, especially to a sound generator with a great amplitude. Further, the top cover attached to the frame is used for sandwiching the first positioning portion and the second positioning portion between the frame and the top cover, such that the combination strength between the first part and the second part is improved, and the waterproof grade is effectively improved. The configuration and the material of the second part increases the effective vibration area of the diaphragm, which makes the high frequency improve to ultrasonic frequency band (20~40 KHz), and makes it possible to serve as a key component of gesture recognition.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound generator, comprising:

a frame;

a magnetic circuit system accommodated in the frame;

a vibration system in the frame, including a suspension having:

a first part connected to the frame, including a first middle portion, a first edge portion extending away from the first middle portion, and a first positioning portion extending away from the first edge portion;

a second part stacked to the first part, including a second middle portion attached to the first middle portion, a second edge portion extending away from the second middle portion, and a second positioning portion extending away from the second edge portion for being attached to the first positioning portion; wherein the first edge portion is convex toward the frame, and the second edge portion is convex away from the frame, and a sealed cavity is formed between the first and second edge portions;

the sound generator further including a top cover coupled to the frame, and the first and second positioning portions are sandwiched between the frame and the top cover.

2. The sound generator as described in claim 1, wherein the second edge portion is convex far away from the frame and forms a first height, and the first edge portion is convex toward the frame and forms a second height greater than the first height.

3. The sound generator as described in claim 1, wherein the vibration system further includes a dome attached to the second middle portion of the second part.

4. The sound generator as described in claim 2, wherein the first part is formed by TPEE (Thermoplastic Polyether Ester Elastomer).

5. The sound generator as described in claim 4, wherein the second part is a three-layer-structure including a layer of TPEE (Thermoplastic Polyether Ester Elastomer), a layer of carbon fiber, and a layer of PEEK (Polyether-ether-ketone).

6. The sound generator as described in claim 3, wherein the first part includes at least one layer of PEEK, and the second part is made of TPEE.

7. The sound generator as described in claim 3, wherein the dome is made of alloy materials selected from aluminum alloy, magnesium alloy, magnesium lithium alloy, aluminum lithium alloy and titanium alloy, or made of polymer materials selected from polyethylene and polyester.

* * * * *